US007913995B2

(12) United States Patent
Clark et al.

(10) Patent No.: US 7,913,995 B2
(45) Date of Patent: Mar. 29, 2011

(54) METHOD AND APPARATUS FOR NON-CONTACT MEASUREMENT OF A MEDIA STACK IN AN IMAGE PRODUCTION DEVICE

(75) Inventors: Robert Alan Clark, Williamson, NY (US); Kenneth Paul Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 128 days.

(21) Appl. No.: 12/465,694

(22) Filed: May 14, 2009

(65) Prior Publication Data

US 2010/0289209 A1 Nov. 18, 2010

(51) Int. Cl.
*B65H 1/18* (2006.01)

(52) U.S. Cl. ..... 271/126; 271/152

(58) Field of Classification Search ..... 271/148, 271/152, 153, 154, 155, 30.1, 31
See application file for complete search history.

(56) References Cited

U.S. PATENT DOCUMENTS 5,207,416 A * 5/1993 Soler ..... 271/31
6,186,492 B1 * 2/2001 Dechau et al. ..... 271/30.1
6,290,225 B1 * 9/2001 Linder et al. ..... 271/155
6,349,936 B1 * 2/2002 Muller et al. ..... 271/265.01
7,267,337 B2 * 9/2007 Moore et al. ..... 271/148
7,464,926 B2 * 12/2008 Moore et al. ..... 271/148
2010/0270733 A1 * 10/2010 Freeston ..... 271/126

OTHER PUBLICATIONS

Clark et al.; U.S. Appl. No. 12/187,930; filed Aug. 7, 2008.
DeGruchy et al.; U.S. Appl. No. 12/261,463; filed Oct. 30, 2008.

* cited by examiner

*Primary Examiner* — Kaitlin S Joerger
(74) *Attorney, Agent, or Firm* — Ronald E. Prass, Jr.; Prass LLP

(57) ABSTRACT

A method and apparatus for non-contact measurement of a media stack in an image production device is disclosed that may include detecting the position of an unfluffed media stack, setting a desired media stack height by changing a media elevator position using a media elevator control unit based on the detected unfluffed media stack position, determining if printing and fluffing has started, wherein if it is determined that printing and fluffing has started, detecting the position of the transition between the fluffed and unfluffed portions of the media stack using the one or more sensors, determining if the position of the transition between the fluffed and unfluffed portions of the media stack is below a predetermined threshold, wherein if it is determined that the position of the transition between the fluffed and unfluffed portions of the media stack is below the predetermined threshold, setting the desired media stack height by changing the media elevator position based on the detected position of the transition between the fluffed and unfluffed portions of the media stack.

18 Claims, 8 Drawing Sheets

METHOD AND APPARATUS FOR NON-CONTACT MEASUREMENT OF A MEDIA STACK IN AN IMAGE PRODUCTION DEVICE

BACKGROUND

Disclosed herein is a method for non-contact measurement of a media stack in an image production device, as well as corresponding apparatus and computer-readable medium.

In current feeder designs which utilize a stack elevator, the stack height is detected using some form of contact sensor. With vacuum corrugated feeders, the top (or bottom) of the media stack is fluffed with pressurized air to facilitate reliable sheet acquisition by the feed head. However, this process impedes accurate detection of stack height for a top vacuum feeder during a print job as the air pressure between the sheets causes the stack height sensor to indicate a stack height higher than it is in reality. To counteract the lifting force from the air pressure, it may be necessary to increase the amount of force applied by the sensor arm without causing sheet fluffing/acquisition problems.

SUMMARY

A method and apparatus for non-contact measurement of a media stack in an image production device is disclosed that may include detecting the position of an unfluffed media stack, setting a desired media stack height by changing a media elevator position using a media elevator control unit based on the detected unfluffed media stack position, determining if printing and fluffing has started, wherein if it is determined that printing and fluffing has started, detecting the position of the transition between the fluffed and unfluffed portions of the media stack using one or more sensors, determining if the position of the transition between the fluffed and unfluffed portions of the media stack is below a predetermined threshold, wherein if it is determined that the position of the transition between the fluffed and unfluffed portions of the media stack is below the predetermined threshold, setting the desired media stack height by changing the media elevator position based on the detected position of the transition between the fluffed and unfluffed portions of the media stack.

DETAILED DESCRIPTION

Figure 1:
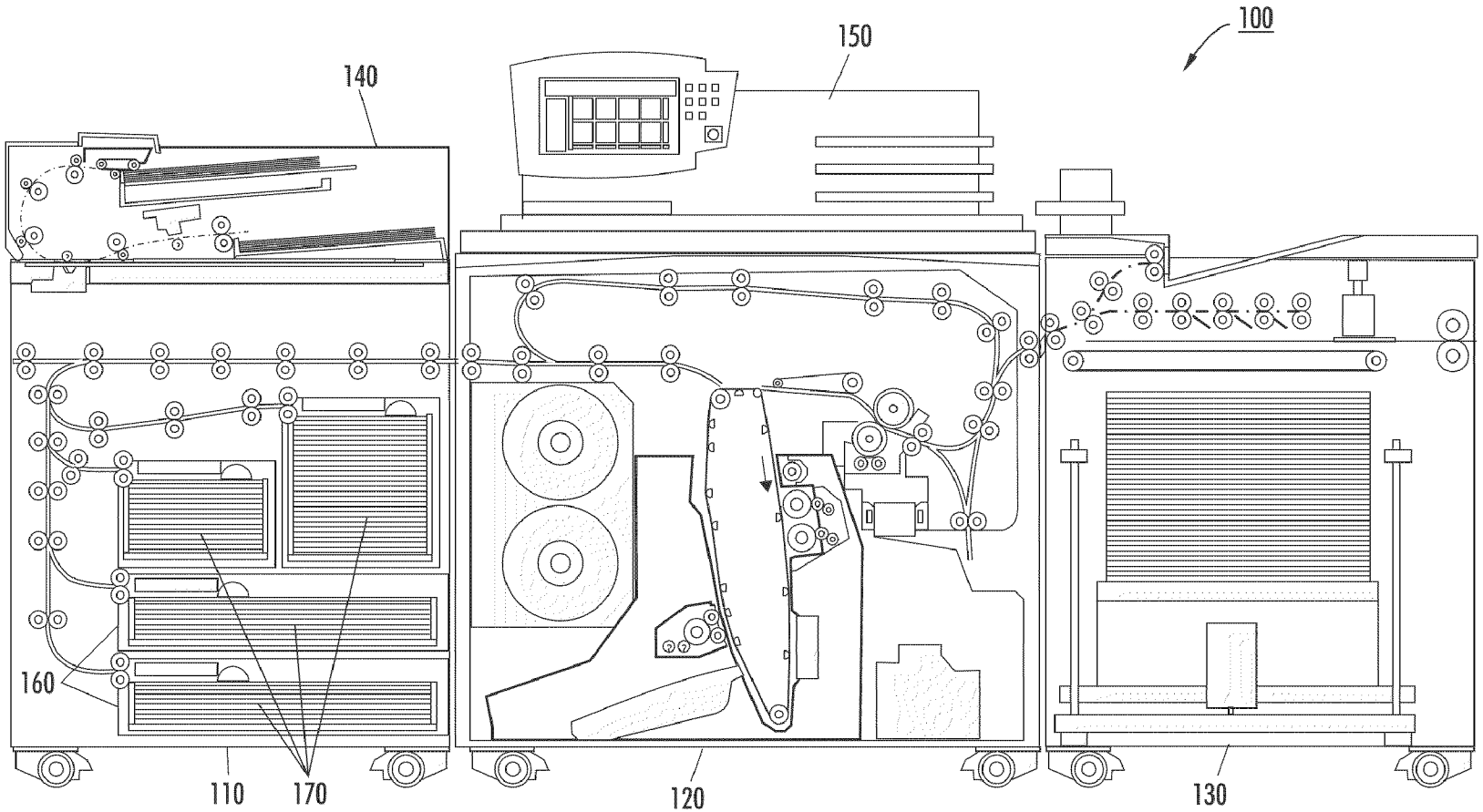
FIG. 1 is an exemplary diagram of an image production device in accordance with one possible embodiment of the disclosure.

Aspects of the embodiments disclosed herein relate to a method for non-contact measurement of a media stack in an image production device, as well as corresponding apparatus and computer-readable medium.

The disclosed embodiments may include a method for non-contact measurement of a media stack in an image production device. The method may include detecting the position of an unfluffed media stack using one or more sensors, setting a desired media stack height by changing a media elevator position using a media elevator control unit based on the detected unfluffed media stack position, determining if printing and fluffing has started, wherein if it is determined that printing and fluffing has started, detecting a number and thickness of the fluffed media sheets using the one or more sensors, calculating a sum of the fluffed media sheet thicknesses, determining if the calculated sum of the fluffed media sheet thicknesses is below a predetermined threshold, wherein if it is determined that the calculated sum of the fluffed media sheet thicknesses is below the predetermined threshold, setting the desired media stack height by changing the media elevator position using the media elevator control unit based on the calculated sum of the fluffed media sheet thicknesses.

The disclosed embodiments may further include an image production device that may include one or more sensors that detect the position of an unfluffed media stack and detect a number and thickness of the fluffed media sheets, a media elevator control unit that controls movement of the media elevator to set the position of the media stack, and a media stack adjustment module that sets a desired media stack height by using the media elevator control unit to change the media elevator position based on the detected unfluffed media stack position, determines if printing and fluffing has started, wherein if the media stack adjustment module determines that printing and fluffing has started, the media stack adjustment module calculates a sum of the fluffed media sheet thicknesses, determines if the calculated sum of the fluffed media sheet thicknesses is below a predetermined threshold, wherein if the media stack adjustment module determines that the calculated sum of the fluffed media sheet thicknesses is below the predetermined threshold, the media stack adjustment module sets the desired media stack height using the media elevator control unit to change the media elevator position based on the calculated sum of the fluffed media sheet thicknesses.

The disclosed embodiments may include a method for non-contact measurement of a media stack in an image production device. The method may include detecting the position of an unfluffed media stack using one or more sensors, setting a desired media stack height by changing a media elevator position using a media elevator control unit based on the detected unfluffed media stack position, determining if printing and fluffing has started, wherein if it is determined that printing and fluffing has started, detecting the position of the transition between the fluffed and unfluffed portions of the media stack using the one or more sensors, determining if the position of the transition between the fluffed and unfluffed portions of the media stack is below a predetermined threshold, wherein if it is determined that the position of the transition between the fluffed and unfluffed portions of the media stack is below the predetermined threshold, setting the desired media stack height by changing the media elevator position using the media elevator control unit based on the detected position of the transition between the fluffed and unfluffed portions of the media stack.

The disclosed embodiments may further include an image production device that may include one or more sensors that detect the position of the transition between the fluffed and unfluffed portions of the media stack, a media elevator control unit that controls movement of the media elevator to set the position of the media stack, and a media stack adjustment module that sets a desired media stack height by using the media elevator control unit to change the media elevator position based on the detected unfluffed media stack position, determines if printing and fluffing has started, wherein if the media stack adjustment module determines that printing and fluffing has started, the media stack adjustment module determines if the position of the transition between the fluffed and unfluffed portions of the media stack is below a predetermined threshold, wherein if the media stack adjustment module determines that the position of the transition between the fluffed and unfluffed portions of the media stack is below the predetermined threshold, the media stack adjustment module sets the desired media stack height using the media elevator control unit to change the media elevator position based on the detected position of the transition between the fluffed and unfluffed portions of the media stack.

The disclosed embodiments may concern a method and apparatus for a method for non-contact measurement of a media stack in an image production device. The process may use a non-contact media stack height sensor (that may also act as a media fluff sensor) that may be a linear optical array sensor or any other type of sensor that may take a "snapshot" of a media stack at a given point in the media feed cycle. This image data may then be processed to determine the number of gaps between the fluffed media sheets, as well as the thickness of the fluffed media sheets. While also using this information to adjust fluffer pressures for optimal fluffing, the image data may also use the measured thicknesses and number of the fluffed media sheets to calculate what the media stack height would be if the sheets were not fluffed.

This image information may provide a continuous measurement of the media stack height during a print job run, as opposed to conventional methods which concern a media stack height "OK/too low" input provided by the conventional digital stack height sensors currently in use. The process described in the disclosed embodiments may enable tighter control of the stack height, which may yield more reliable feeder performance. The process may also eliminate the need for the separate "contact method" stack height sensing system which may help to offset the sensor cost. Moreover, this process may result in reduced media marking, improved reliability, and the potential for higher pages-per-minute (PPM) feed rates.

At the outset of a print job, the media stack sensor may be used to detect the position of the unfluffed media stack. A media stack adjustment module may then use a media elevator control unit to set the correct stack height for the paper being fed. Once the fluffing system is activated and the feeder starts committing sheets to the paper path, the media stack sensor may be used to detect the number and thickness of the fluffed media sheets. After each feed, the sum of the sheet thicknesses may be calculated. If this sum falls below a previously specified threshold, the media elevator may be incremented a set amount to maintain desired stack height. This mode of operation may continue until the end of the print job.

With regards to the disclosed embodiments, the following aspects of determining the stack height may be considered:

1. Calculating the sum of the fluffed media sheet thicknesses, which is proportional to the stack height. Note that this process assumes that the sheet edges can be imaged with sufficient resolution such that accurate thickness measurements of the individual sheets can be obtained.
2. Detecting the transition between the fluffed and unfluffed portions of the stack. As discussed above, this process is more robust to poor image quality. This process may provide the ability to implement the disclosed embodiments with a lower cost sensor.

Some of the features provided by the disclosed embodiments may include:

Measurement of media stack height from the side of a fluffed media stack without media stack contact. Other media stack height sensing schemes rely on a contact-type approach which compresses the fluffed media stack and can contribute to sheet marking.

A more continuous measurement than is provided by existing media stack height sensor mechanisms. This process may enable better media stack height control, which will lead to better feeder performance.

Combination of fluff and stack height measurement. By replacing the existing media stack height sensor mechanism, the cost impact should either be a small increase or a cost savings.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a feeder section 110, which stores and dispenses sheets on which images are to be printed, and an output section 130, which may include hardware for stacking, folding, stapling, binding, etc., prints which are output from the marking engine. If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module includes any number of trays 160, each of which stores a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer 190, vacuum grip or other application of air pressure toward the top sheet or sheets in a media stack 170. The fluffer 190 may blow air onto the edge of a media stack 170 to create separation between the media sheets in order to avoid jamming of the image production device 100.

Figure 5:
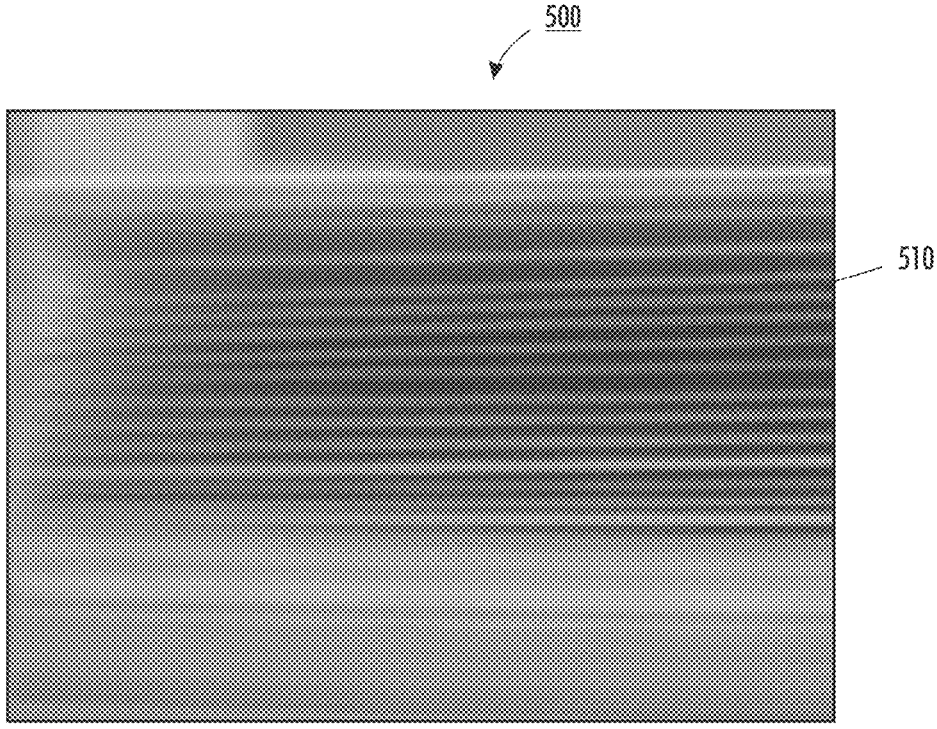
FIG. 5 is a diagram of a media stack being fluffed by a fluffer in accordance with one possible embodiment of the disclosure.

FIG. 5 shows an example 500 of a media stack 510 being fluffed by a fluffer 190. Certain types of coated media are advantageously drawn from a media stack 170 by the use of an application of heat, such as by a stream of hot air blown on the media stack 170 using the fluffer 190, for example.

Sensor 180 may represent or include one or more non-contact sensors that may detect the position of an unfluffed media stack and detect a number and thickness of the fluffed media sheets, such as one or more linear-optical sensor, a charge-coupled device sensor, or a Complementary Metal Oxide Semiconductor (CMOS) sensor. The one or more sensors 180 may detect the number and thickness of the fluffed media sheets after each media sheet is fed for processing, for example. In addition, the one or more sensors 180 may also provide input to increase or decrease the air flow from the fluffer 190.

Once fluffed, the sheets of media drawn from a media stack 170 on a selected tray 160 may then be moved to the image production section 120 to receive one or more images thereon. Then, the printed sheet is then moved to output section 130, where it may be collated, stapled, folded, etc., with other media sheets in manners familiar in the art.

Figure 2:
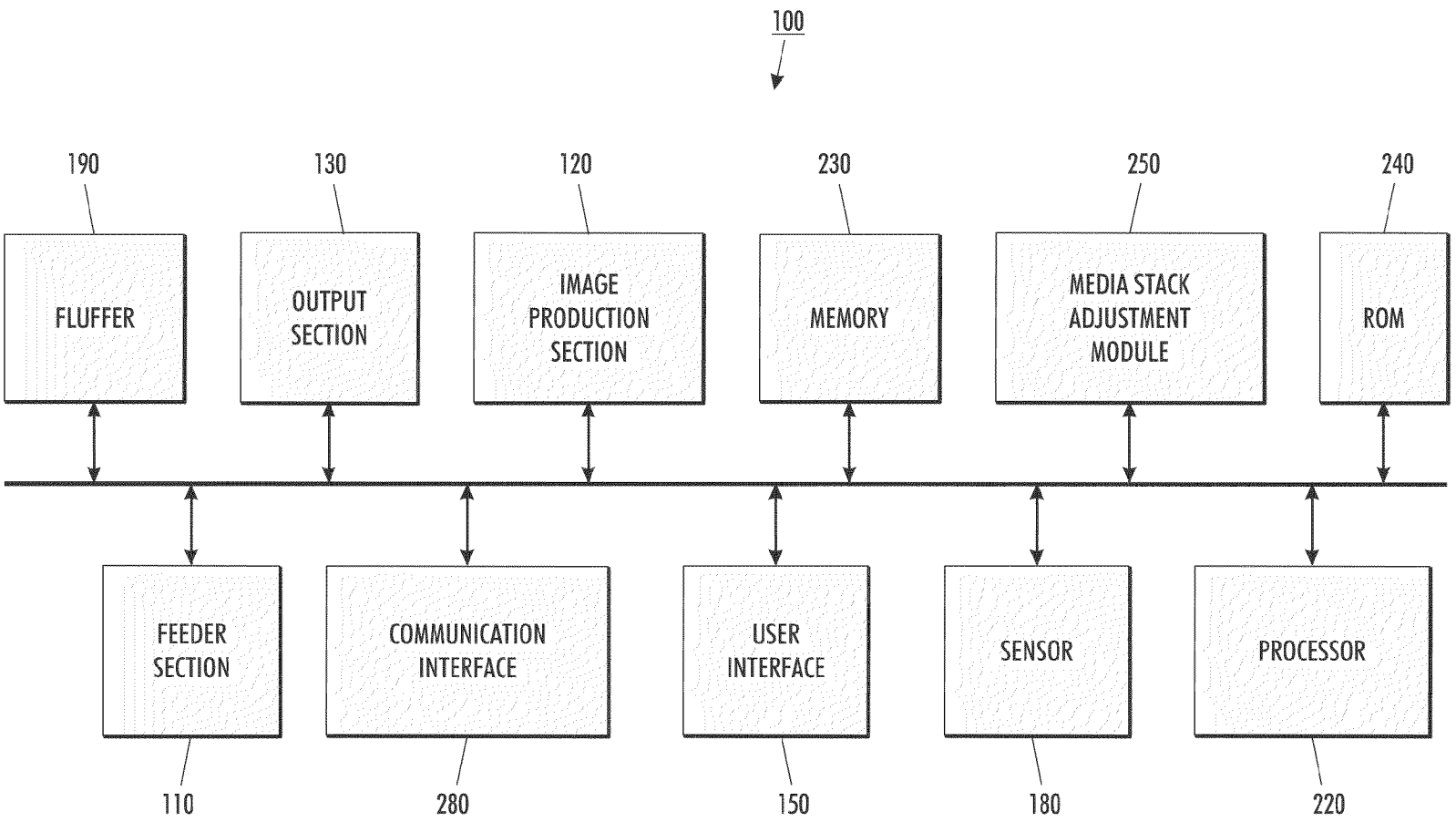
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a media stack adjustment module 250, a feeder section 110, an output section 130, a user interface 150, a communication interface 280, an image production section 120, sensor 180, and fluffer 190. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

As stated above, user interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, a spreader, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

The operation of the media stack adjustment module 250 and the sensor (or one or more sensors) 180 will be discussed in relation to the block diagram in FIG. 3 and the flowchart in FIG. 6.

Figure 3:
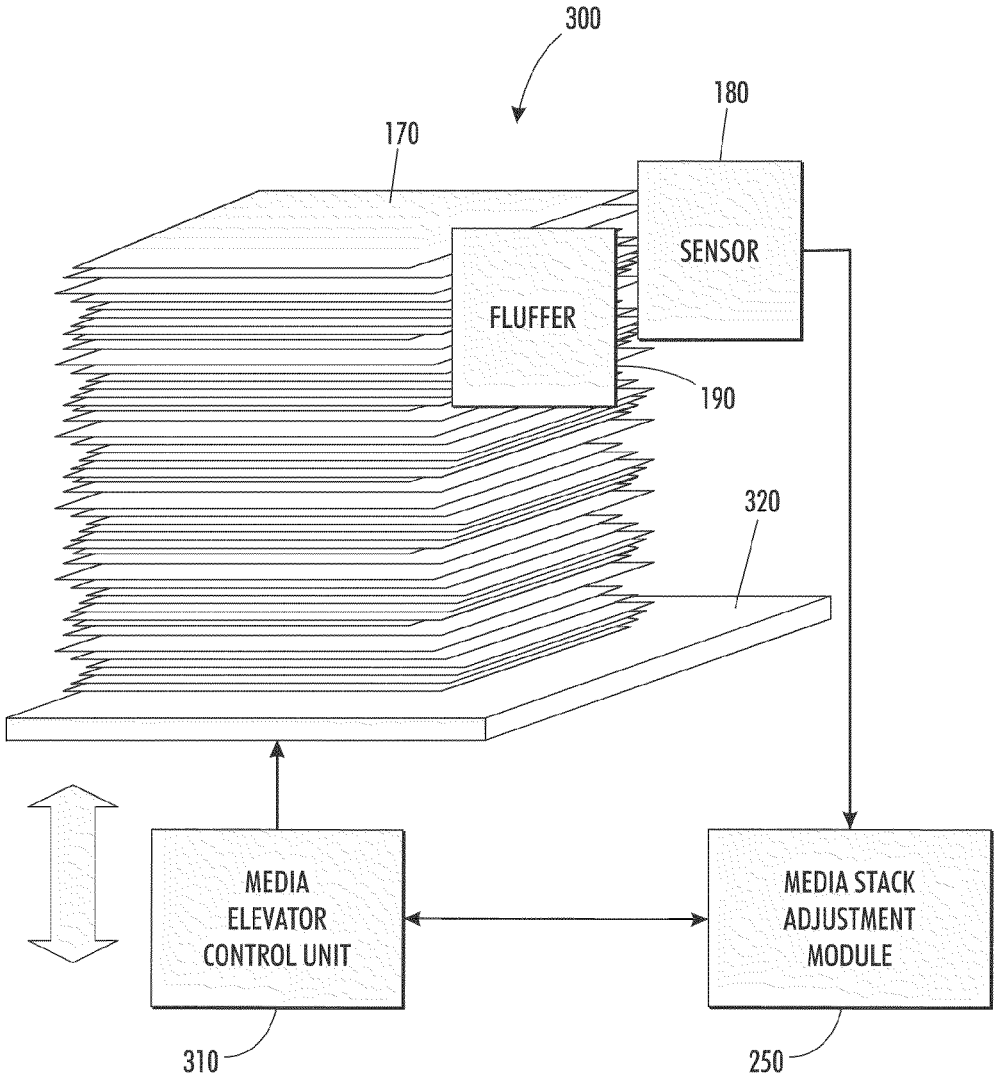
FIG. 3 is an exemplary diagram of a non-contact media stack measurement environment in the image production device in accordance with one possible embodiment of the disclosure.

FIG. 3 is an exemplary diagram of a non-contact media stack measurement environment 300 in the image production device in accordance with one possible embodiment of the disclosure. The non-contact media stack measurement environment 300 may be found in the feeder section 110 and may include media elevator control unit 310, media elevator 320, one or more sensors 180, the media stack adjustment module 250, and the fluffer 190 to direct air toward the edge of the media stack 170. Note that the fluffer 190 may be any contact or non-contact device that facilities the separation of media sheets in a media stack 170, such as a mechanical fanner, for example.

While the term media stack 170 is used for ease of discussion, the media stack 170 may represent any type of media sheets used to produce documents in the image production device 100, such as any type of paper, plastic, photo paper, cardboard, etc. In addition, for ease of discussion, the term media stack 170 may represent an entire media stack or a portion of a media stack, for example.

As shown, as media sheets are being fluffed by the fluffer 190, the one or more sensors 180 may provide signals concerning the height (or position) of media sheets in the media stack 170 to the media stack adjustment module 250. Then, based on the sensor 180 input, the media stack adjustment module 250 may then provide input to the media elevator control unit 310 to change the height of the media elevator 320.

During the process, as sheets are being fed to the image production section 120 for image processing, the media stack 170 decreases in size. As this decrease is detected by the sensor 180 (as discussed below), the media elevator 320 must be raised by the media elevator control unit 310 to provide the optimal media stack height to prevent jamming and provide the fastest and most efficient media sheet feed possible. The sensor 180 may also provide input to the media stack adjustment module 250 or a fluffer controller (not shown) to increase or decrease the air flow to the fluffer 190 depending on factors such as the type media, environmental conditions (e.g., temperature and/or humidity), etc.

Figure 4:
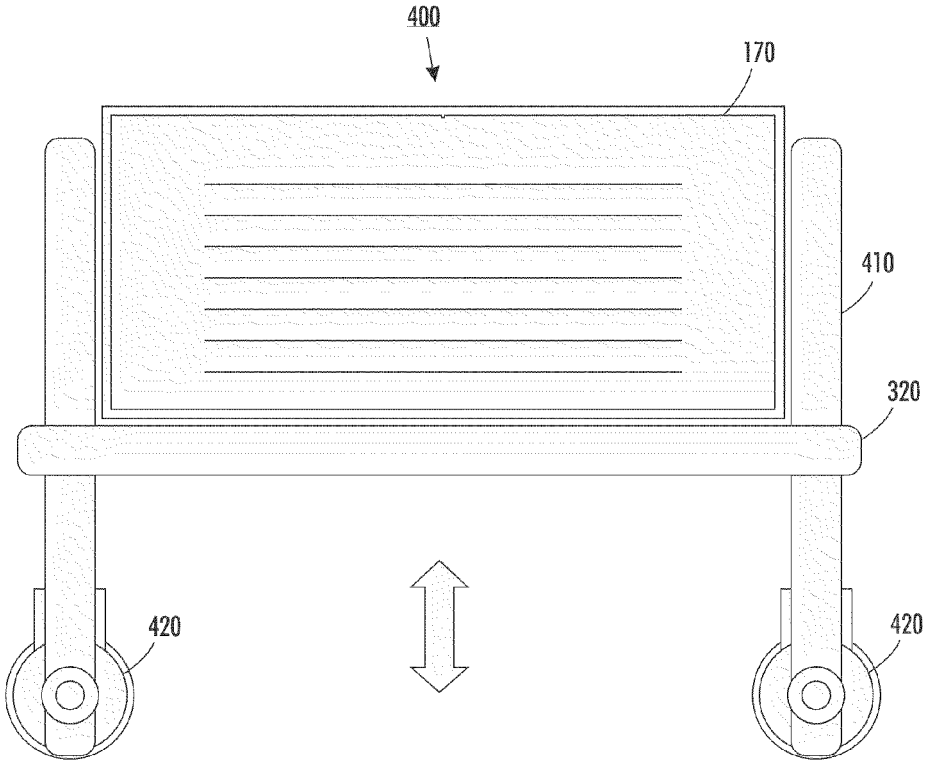
FIG. 4 is an exemplary diagram of a possible media elevator unit in accordance with one possible embodiment of the disclosure.

FIG. 4 is an exemplary diagram of a possible media elevator unit 400 in accordance with one possible embodiment of the disclosure. The media elevator unit 400 may include a media elevator 320 that may be adjusted by the media elevator control unit 310 in order to accommodate the characteristics of various sheet types and media quantity conditions of the media stack 170. The media elevator unit 400 may also includes multiple tray elevator slots 410 and elevator drives 420 for raising or lowering the media elevator 320 holding the media stack 170. Note that this type of media elevator unit 400 is shown for illustrative purposes only. The disclosed embodiments may be applied to any media elevator type in any image production device 100.

Figure 6:
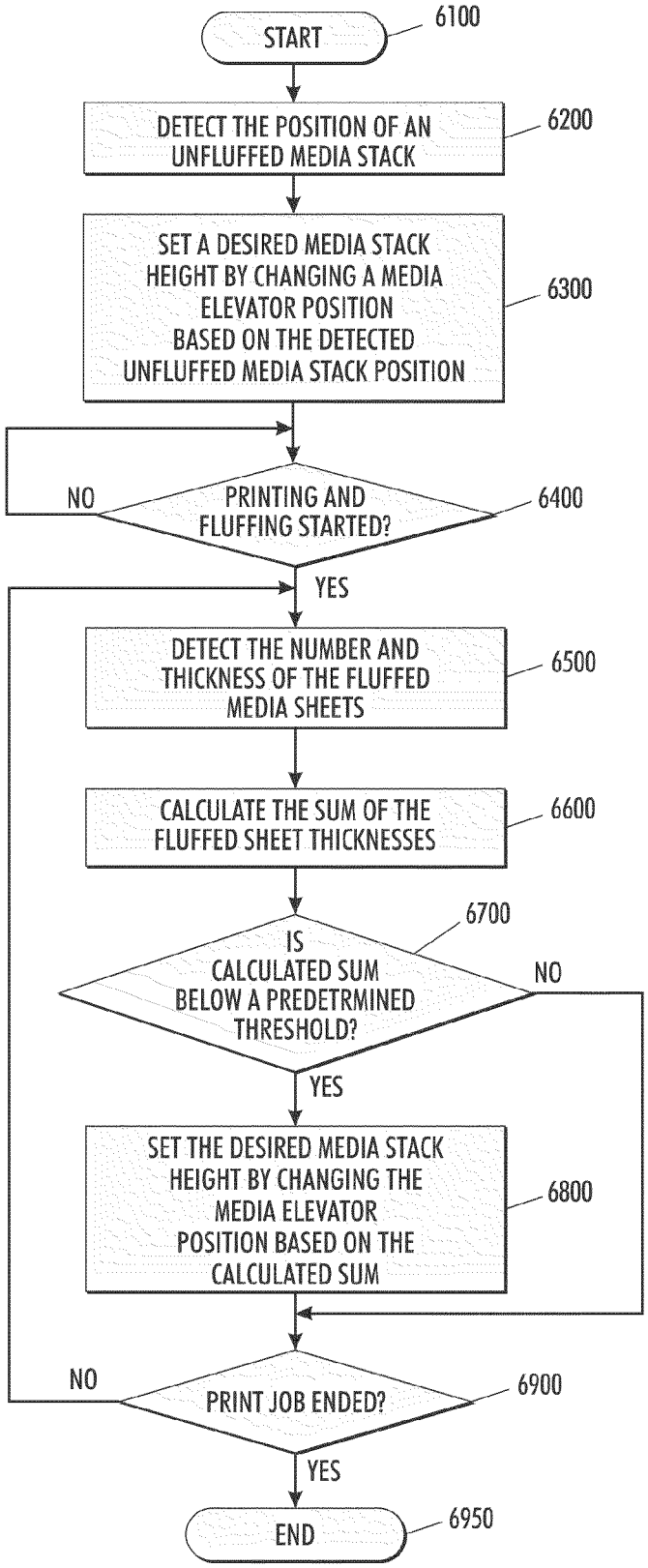
FIG. 6 is a flowchart of an exemplary non-contact media stack measurement process in accordance with one possible embodiment of the disclosure.

FIG. 6 is a flowchart of a fluffer environmental control process in accordance with one possible embodiment of the disclosure. The process begins at step 6100, and continues to step 6200 where the one or more sensors 180 may detect the position of an unfluffed media stack 170. At step 6300, the media stack adjustment module 250 may set a desired media stack height by using the media elevator control unit 310 to change the media elevator 320 position based on the detected unfluffed media stack position.

At step 6400, the media stack adjustment module 250 may determine if printing and fluffing has started. If the media stack adjustment module 250 determines that printing and fluffing has not started, the process may return to step 6400. If at step 6400 the media stack adjustment module 250 determines that printing and fluffing has started, the process goes to step 6500 where the one or more sensors 180 may detect a number and thickness of the fluffed media sheets.

Figure 8:
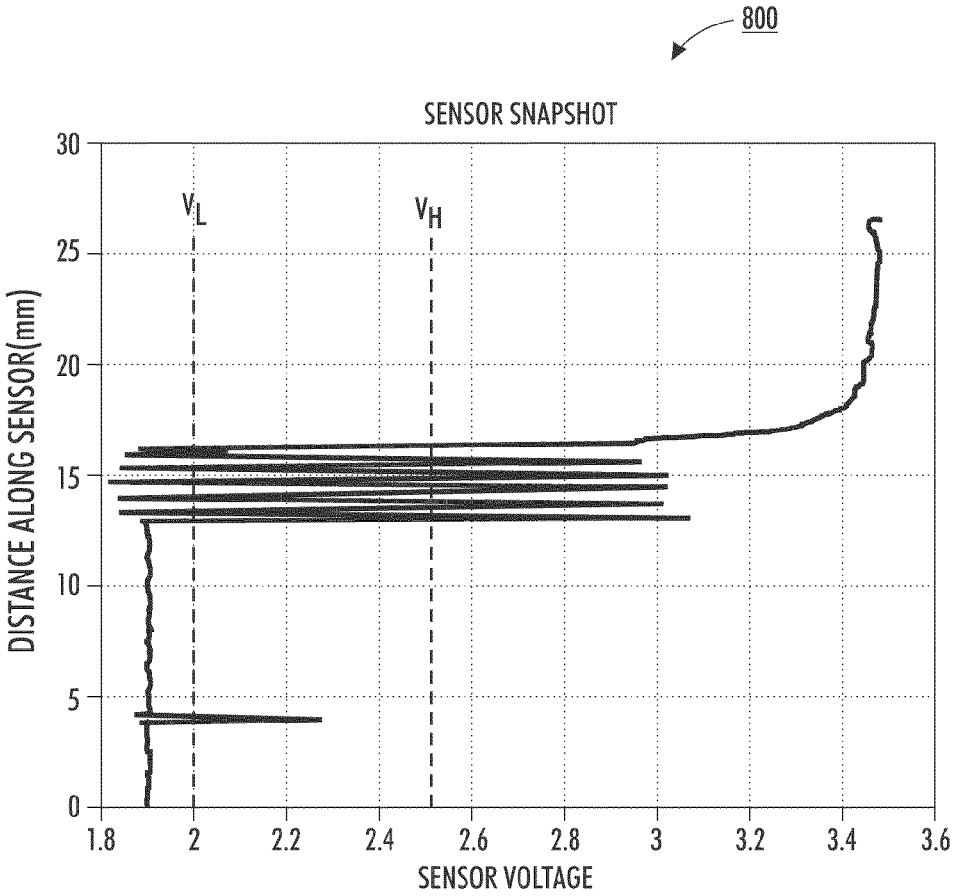
FIG. 8 is an exemplary graph illustrating the sensor voltage vs. the media stack distance along the face of the sensor in accordance with one possible embodiment of the disclosure.

At step 6600, the media stack adjustment module 250 may calculate a sum of the fluffed media sheet thicknesses. At step 6700, the media stack adjustment module 250 may determine if the calculated sum of the fluffed media sheet thicknesses is below a predetermined threshold. FIG. 8 is an exemplary graph 800 illustrating the sensor voltage vs. the media stack distance along the face of the sensor in accordance with one possible embodiment of the disclosure. The graph 800 is a snapshot showing how the raw sensor signal changes on a sheet-to-sheet basis. From these signals, the height of the unfluffed portion of the stack varies in proportion to the measured media stack height.

From the graph 800, the media stack adjustment module 250 may use a first voltage threshold $V_L$ and a second voltage threshold $V_H$ to calculate the fluffed media sheet thicknesses such that each time a signal from a sensor drops below $V_L$, the number of pixels are counted and if the signal from the sensor then exceeds $V_H$, the number of pixels are multiplied by a pixel pitch to obtain the fluffed media sheet thickness. The pixel count is then reset to 0.

A similar approach may be used to calculate the gap widths. The corresponding pixel counts are then multiplied by the pixel pitch to obtain the actual sheet thickness and gap width data. From observation, it can be clearly seen that the transition between the fluffed and unfluffed portions of the stack 170 is about 12.5 mm along the face of the sensor. In the cases where sheets fluffed away from the sensor focal depth, the corresponding signals would weaken (i.e. drift to the right on the figure) and the calculation scheme given above would yield inaccurate results. However, it was visually observed that the signal generated by the unfluffed portion of the media stack 170 was reasonably consistent.

Thus, the process may be modified to detect the point on the unfluffed portion of the media stack 170 in which the signal first crossed $V_L$ going left to right) while also crossing $V_H$ without returning to $V_L$. This point is considered to be the transistion between the fluffed and unfluffed portions of the media stack. This technique may be performed to eliminate false gap detection due to small gaps in the media stack 170 (such as can be found at ream interfaces).

The predetermined criteria may be the number of sensor pixels per sheet of media, for example. As the pixel-to-pixel distance is known, the number of sensor pixels per sheet of media may then be used to calculate the sheet thickness. Should the calculated thickness of a given fluffed media sheet be substantially greater than the thickness of other fluffed media sheets, the given fluffed media sheet may actually represent a group of media sheets clumped together.

Thus, returning to FIG. 6, if at step 6700, the media stack adjustment module 250 determines that the calculated sum of the fluffed media sheet thicknesses is not below the predetermined threshold, the process may go to step 6900. However, if at step 6700 the media stack adjustment module 250 determines that the calculated sum of the fluffed media sheet thicknesses is below the predetermined threshold, at step 6800 the media stack adjustment module 250 may set the desired media stack height using the media elevator control unit 310 to change the media elevator 320 position based on the calculated sum of the fluffed media sheet thicknesses.

At step 6900, the media stack adjustment module 250 may determine if the print job has ended. If the media stack adjustment module 250 determines that the print job has not ended, the process may return to step 6500. However, if the media stack adjustment module 250 determines that the print job has ended, the media stack adjustment module 250 stops measurement of the media stack and the process may go to step 6950 and end.

Figure 7:
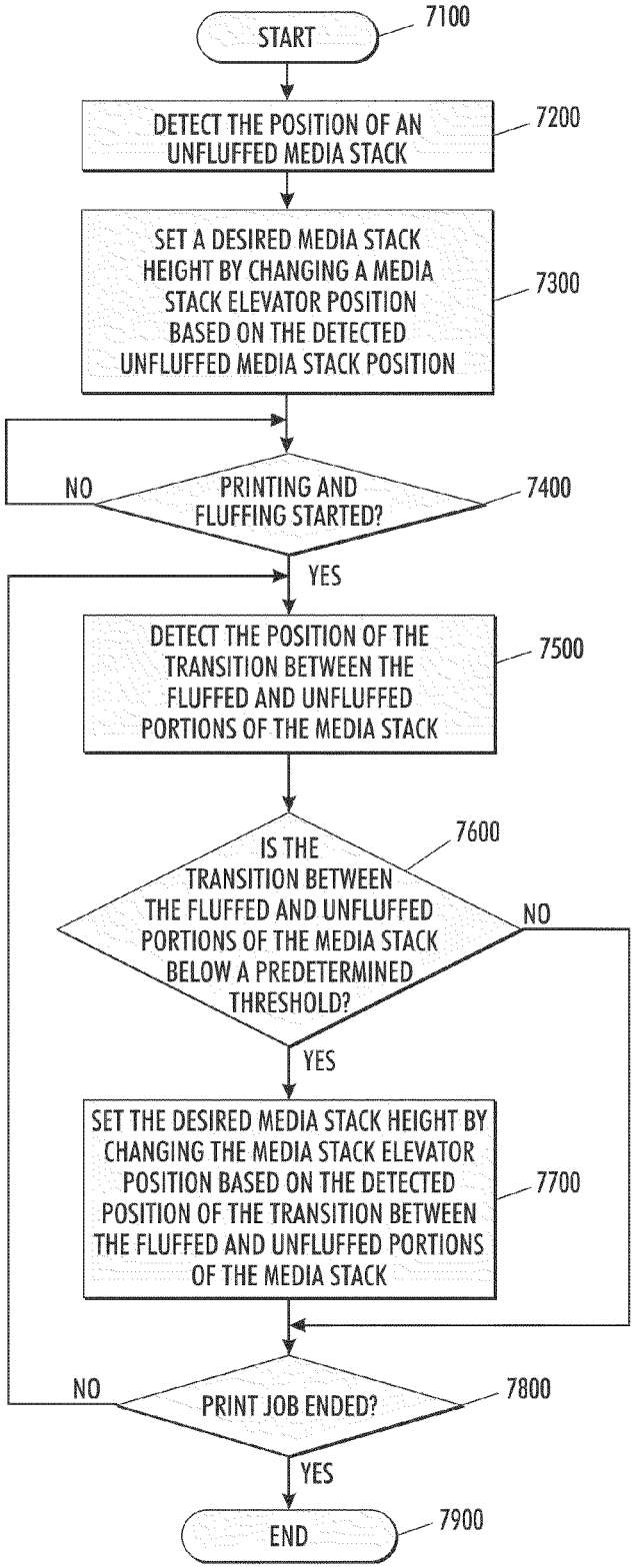
FIG. 7 is a flowchart of another exemplary non-contact media stack measurement process in accordance with one possible embodiment of the disclosure.

FIG. 7 is a flowchart of another fluffer environmental control process in accordance with one possible embodiment of the disclosure. The process in steps 7100, 7200, 7300, and 7400 is similar to the process discussed above in relation to steps 6100, 6200, 6300, and 6400 and will not be repeated here. At step 7500, the one or more sensors 180 may detect the position of the transition between the fluffed and unfluffed portions of the media stack 170.

At step 7600, the media stack adjustment module 250 may determine if the position of the transition between the fluffed and unfluffed portions of the media stack 170 is below a predetermined threshold. If the media stack adjustment module 250 determines that the position of the transition between the fluffed and unfluffed portions of the media stack 170 is not below a predetermined threshold, the process may go to step 7800. However, if the media stack adjustment module 250 determines that the position of the transition between the fluffed and unfluffed portions of the media stack 170 is below a predetermined threshold, at step 7700, the media stack adjustment module 250 may set the desired media stack height using the media elevator control unit 310 to change the media elevator 320 position based on the detected position of the transition between the fluffed and unfluffed portions of the media stack 170.

At step 7800, the media stack adjustment module 250 may determine if the print job has ended. If the media stack adjustment module 250 determines that the print job has not ended, the process may return to step 7500. However, if the media stack adjustment module 250 determines that the print job has ended, the media stack adjustment module 250 stops measurement of the media stack and the process may go to step 7900 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for non-contact measurement of a media stack in an image production device, comprising:

detecting the position of an unfluffed media stack using one or more sensors;

setting a desired media stack height by changing a media elevator position using a media elevator control unit based on the detected unfluffed media stack position;

determining if printing and fluffing has started, wherein if it is determined that printing and fluffing has started, detecting a number and thickness of the fluffed media sheets using the one or more sensors;

calculating a sum of the fluffed media sheet thicknesses;

determining if the calculated sum of the fluffed media sheet thicknesses is below a predetermined threshold, wherein if it is determined that the calculated sum of the fluffed media sheet thicknesses is below the predetermined threshold, setting the desired media stack height by changing the media elevator position using the media elevator control unit based on the calculated sum of the fluffed media sheet thicknesses, wherein a first voltage threshold $V_L$ and a second voltage threshold $V_H$ are used to calculate the fluffed media sheet thicknesses such that each time a signal from a sensor drops below $V_L$, the number of pixels are counted and if the signal from the sensor then exceeds $V_H$, the number of pixels are multiplied by a pixel pitch to obtain the fluffed media sheet thickness.

2. The method of claim 1, further comprising:

determining if the print job has ended, wherein if it is determined that the print job has ended, stopping measurement of the media stack.

3. The method of claim 1, wherein the one or more sensors are at least one of a linear-optical sensor, a charge-coupled device sensor, and a Complementary Metal Oxide Semiconductor sensor.

4. The method of claim 1, wherein the image production device is one of a copier, a printer, a facsimile device, and a multi-function device.

5. An image production device, comprising:

one or more sensors that detect the position of an unfluffed media stack and detect a number and thickness of the fluffed media sheets;

a media elevator control unit that controls movement of the media elevator to set the position of the media stack; and a media stack adjustment module that sets a desired media stack height by using the media elevator control unit to change the media elevator position based on the detected unfluffed media stack position, determines if printing and fluffing has started, wherein if the media stack adjustment module determines that printing and fluffing has started, the media stack adjustment module calculates a sum of the fluffed media sheet thicknesses, determines if the calculated sum of the fluffed media sheet thicknesses is below a predetermined threshold, wherein if the media stack adjustment module determines that the calculated sum of the fluffed media sheet thicknesses is below the predetermined threshold, the media stack adjustment module sets the desired media stack height using the media elevator control unit to change the media elevator position based on the calculated sum of the fluffed media sheet thicknesses, wherein the media stack adjustment module uses a first voltage threshold $V_L$ and a second voltage threshold $V_H$ to calculate the fluffed media sheet thicknesses such that each time a signal from a sensor drops below $V_L$, the number of pixels are counted and if the signal from the sensor then exceeds $V_H$, the number of pixels are multiplied by a pixel pitch to obtain the fluffed media sheet thickness.

6. The image production device of claim 5, wherein the media stack adjustment module determines if the print job has ended, wherein if the media stack adjustment module determines that the print job has ended, the media stack adjustment module stops measurement of the media stack.

7. The image production device of claim 5, wherein the one or more sensors are at least one of a linear-optical sensor, a charge-coupled device sensor, and a Complementary Metal Oxide Semiconductor sensor.

8. The image production device of claim 5, wherein the image production device is one of a copier, a printer, a facsimile device, and a multi-function device.

9. A method for non-contact measurement of a media stack in an image production device, comprising:

detecting the position of an unfluffed media stack using one or more sensors;

setting a desired media stack height by changing a media elevator position using a media elevator control unit based on the detected unfluffed media stack position;

determining if printing and fluffing has started, wherein if it is determined that printing and fluffing has started, detecting the position of the transition between the fluffed and unfluffed portions of the media stack using the one or more sensors;

determining if the position of the transition between the fluffed and unfluffed portions of the media stack is below a predetermined threshold, wherein if it is determined that the position of the transition between the fluffed and unfluffed portions of the media stack is below the predetermined threshold, setting the desired media stack height by changing the media elevator position using the media elevator control unit based on the detected position of the transition between the fluffed and unfluffed portions of the of the media stack, wherein a first voltage threshold $V_L$ and a second voltage threshold $V_H$ are used to determine the position of the transition between the fluffed and unfluffed portions of the media stack such that each time a signal from a sensor drops below $V_L$, the number of pixels are counted and if the signal from the sensor then exceeds $V_H$, the number of pixels are multiplied by a pixel pitch to obtain the fluffed media sheet thickness.

10. The method of claim 9, further comprising:

determining if the print job has ended, wherein if it is determined that the print job has ended, stopping measurement of the media stack.

11. The method of claim 9, wherein the one or more sensors are at least one of a linear-optical sensor, a charge-coupled device sensor, and a Complementary Metal Oxide Semiconductor sensor.

12. The method of claim 9, wherein the one or more sensors detect the transition between the fluffed and unfluffed portions of the media stack after each media sheet is fed for processing.

13. The method of claim 9, wherein the image production device is one of a copier, a printer, a facsimile device, and a multi-function device.

14. An image production device, comprising:

one or more sensors that detect the position of the transition between the fluffed and unfluffed portions of the media stack;

a media elevator control unit that controls movement of the media elevator to set the position of the media stack; and a media stack adjustment module that sets a desired media stack height by using the media elevator control unit to change the media elevator position based on the detected unfluffed media stack position, determines if printing and fluffing has started, wherein if the media stack adjustment module determines that printing and fluffing has started, the media stack adjustment module determines if the position of the transition between the fluffed and unfluffed portions of the media stack is below a predetermined threshold, wherein if the media stack adjustment module determines that the position of the transition between the fluffed and unfluffed portions of the media stack is below the predetermined threshold, the media stack adjustment module sets the desired media stack height using the media elevator control unit to change the media elevator position based on the detected position of the transition between the fluffed and unfluffed portions of the media stack, wherein the media stack adjustment module uses a first voltage threshold $V_L$ and a second voltage threshold $V_H$ to determine the position of the transition between the fluffed and unfluffed portions of the media stack such that each time a signal from a sensor drops below $V_L$, the number of pixels are counted and if the signal from the sensor then exceeds $V_H$, the number of pixels are multiplied by a pixel pitch to obtain the fluffed media sheet thickness.

15. The image production device of claim 14, wherein the media stack adjustment module determines if the print job has ended, wherein if the media stack adjustment module determines that the print job has ended, the media stack adjustment module stops measurement of the media stack.

16. The image production device of claim 14, wherein the one or more sensors are at least one of a linear-optical sensor, a charge-coupled device sensor, and a Complementary Metal Oxide Semiconductor sensor.

17. The image production device of claim 14, wherein the one or more sensors detect the transition between the fluffed and unfluffed portions of the media stack after each media sheet is fed for processing.

18. The image production device of claim 14, wherein the image production device is one of a copier, a printer, a facsimile device, and a multi-function device.

* * * * *